US009084501B2

(12) United States Patent
Pearson

(10) Patent No.: US 9,084,501 B2
(45) **Date of Patent: *Jul. 21, 2015**

(54) DEVICE TO ASSIST PARAPLEGICS WITH GETTING DRESSED

(71) Applicant: Douglas Terry Pearson, Pleasanton, CA (US)

(72) Inventor: Douglas Terry Pearson, Pleasanton, CA (US)

(73) Assignee: PANTS UP EASY LLC, Pleasanton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/327,101

(22) Filed: Jul. 9, 2014

(65) Prior Publication Data

US 2015/0028067 A1 Jan. 29, 2015

Related U.S. Application Data

(60) Provisional application No. 61/947,911, filed on Mar. 4, 2014.

(51) Int. Cl.
*A47G 25/90* (2006.01)

(52) U.S. Cl.
CPC ..... *A47G 25/90* (2013.01)

(58) Field of Classification Search
CPC ..... A47G 25/90
USPC ..... 5/81.1 R, 83.1, 85.1, 86.1, 87.1, 623, 5/662; 4/478, 560.1, 564.1; 248/298.1, 248/118; 135/66, 73; 232/111
See application file for complete search history.

(56) References Cited

U.S. PATENT DOCUMENTS

| | | | | | |
|---|---|---|---|---|---|
| 3,063,752 | A * | 11/1962 | Moore | 297/411.1 |
| 4,065,179 | A * | 12/1977 | Takasaki | 297/464 |
| 4,623,194 | A * | 11/1986 | Pillot | 297/316 |
| 5,357,640 | A * | 10/1994 | McKenney et al. | 5/81.1 R |
| 6,250,717 | B1 * | 6/2001 | Porcheron | 297/411.3 |
| 7,424,756 | B2 * | 9/2008 | Van Raemdonck | 5/81.1 R |
| 2014/0068854 | A1 * | 3/2014 | Konishi | 5/87.1 |

FOREIGN PATENT DOCUMENTS

| | | | | |
|---|---|---|---|---|
| FR | 2653009 | A1 * | 4/1991 | A61G 7/10 |

* cited by examiner

*Primary Examiner* — Michael Trettel
(74) *Attorney, Agent, or Firm* — Gerald R Prettyman

(57) ABSTRACT

The Device to Assist Paraplegics with Getting Dressed is designed to lift a person that has a spinal cord injury or minimal use of their legs above the seat of a wheel chair, or a toilet seat, allowing easy slipping on or off of the pants. The device may be wall mounted wall adjacent to a seating fixture. The device may be mounted on a "free standing" frame, which may have wheels to make it easy to move around and may easily fold up for storage. To use the device a person will, with their arms out to their sides horizontally, put the armpit rest under their arm pit area. On reaching down towards the pants, the armpit rest will turn from horizontal to a vertical position, lifting them up enough to slip the pants on or off.

19 Claims, 9 Drawing Sheets

DEVICE TO ASSIST PARAPLEGICS WITH GETTING DRESSED

CROSS-REFERENCE TO RELATED APPLICATION

This application claims the benefit of priority of U.S. Provisional Patent Application 61/947,911 filed Mar. 4, 2014 and titled "DEVICE TO ASSIST PARAPLEGICS WITH GETTING DRESSED," the disclosure of which is incorporated by reference.

BACKGROUND OF THE INVENTION

1. Field of Invention

The disclosure pertains to a device for assisting people with putting on clothes, and specifically for persons with disabilities giving difficulties for persons to dress themselves.

2. Description of Related Art

There are many infirmities that make putting on clothes difficult for many people. Among these infirmities are debilitating neural illnesses, accidents and other injuries, strokes, birth defects, and for almost everyone at some time, pains and weaknesses brought on by age or life experience.

Assisting these people to dress, or dressing them, takes the effort of a lot of wonderful people who by love or employment, dedicate themselves to assisting persons with infirmities with putting on clothes.

SUMMARY OF THE INVENTION

An embodiment comprises at least one armpit rest (105) having an armpit rest thickness (140), at least one approximately flat lateral side (150) and an armpit rest edge (155), with an armpit rest lobe (145) of the at least one armpit rest (105) having an armpit rest lobe height (160), with the armpit rest lobe height (160) greater than the armpit rest thickness (140), with at least one lateral support (110) securely attached to the at least one armpit rest (105), with a rotational support (120) securely affixed to the at least one lateral support (110) and capable of allowing the at least one armpit rest (105) to rotate radially from an approximately horizontal position to an approximately vertical position and to return the at least one armpit rest (105) to the approximately horizontal position, and at least one vertical support (115) securely affixed to the at least one lateral support (110).

In some embodiments, the rotational support (120) comprises at least one energy storage device (220) affixed to the at least one lateral support (110) and the at least one energy storage device (220) is capable of storing and releasing energy sufficient to rotate the at least one armpit rest (105) from the approximately vertical position to the approximately horizontal position.

In some embodiments, the rotational support (120) further comprises a rotational support body (205) and a rotational support affixment (125) capable of constraining the rotational support (120) from rotation.

In some embodiments, the at least one energy storage device (220) is a spring. In some embodiments, the at least one energy storage device (220) is a torsion bar. In some embodiments, the at least one energy storage device (220) is a ratchet. In some embodiments, the at least one energy storage device (220) is a cam and detent.

In some embodiments, the armpit rest lobe (145) is approximately flat. In some embodiments, the rotational support affixment (125) comprises a rotational support second end (230) constrained through a hollow penetration in the rotational support affixment (125).

In some embodiments, the rotational support affixment (125) may a clamp, weldment, or other affixment on the at least one lateral support (110) at which to affix the at least one lateral support (110) to the at least one energy storage device (220). In some embodiments, the rotational support affixment (125) comprises a rotational support second end (230) constrained through a hollow penetration in the at least one vertical support (115).

In some embodiments, the armpit rest lobe (145) comprises an armpit cavity (545) approximately sized for a human armpit.

Some embodiments further comprise a vertical adjustment device (135) capable of adjusting the vertical position of the at least one armpit rest (105). In some embodiments, the vertical adjustment device (135) comprises inter-sliding channels which may be un-affixed and affixed to adjust the vertical position of the at least one armpit rest (105).

In some embodiments, the at least one lateral support (110) is securely affixed to the rotational support (120).

Some embodiments further comprise a pivot support (130) capable of rotating the at least one lateral support (110) horizontally relative to the at least one vertical support (115). In some embodiments, the pivot support (130) is a hinge.

Some embodiments further comprise at least one diagonal support (570) diagonally affixing the at least one lateral support (510) to the at least one vertical support (515). Some embodiments Some embodiments further comprise a relatively immovably support (565). In some embodiments, the relatively immovably support (565) is a wall (e.g., FIG. 3). In some embodiments, the relatively immovably support (565) is a floor (310).

Some embodiments further comprise a horizontal frame (575). In some embodiments, the horizontal frame (575) comprises a movable base (580). In some embodiments, the movable base (580) comprises a plurality of wheels (585) attached to the movable base (580). In some embodiments, the horizontal frame (575) comprises a horizontal frame pivot (590).

In some embodiments, the rotational support (120) comprises a lateral support affixment (215) on the at least one lateral support (110) for constraining the at least one energy storage device (220) to the at least one lateral support (110). In some embodiments, the lateral support affixment (215) is a hollow penetration, i.e., as for a spring tang or fastener. In some embodiments, the lateral support affixment (215) is a clamp. In some embodiments, the lateral support affixment (215) is a weldment.

In some embodiments, the rotational support (120) comprises at least one lateral support constraint (210, 235) constraining the at least one lateral support (110) from wobble. In some embodiments, the at least one lateral support constraint is a bushing. In some embodiments, the at least one lateral support constraint is a bearing.

In some embodiments, the device further comprises a fixed seating fixture (675). The fixed seating fixture (675) may be a wheelchair

DETAILED DESCRIPTION OF THE INVENTION

Figure 1A:
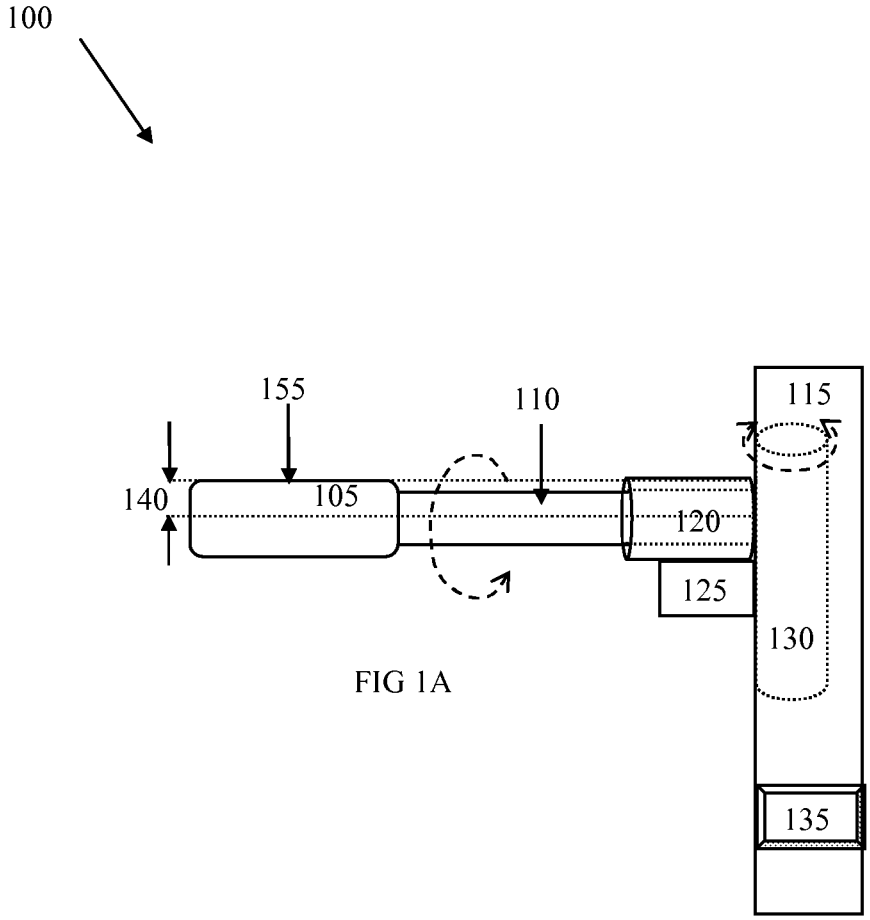
FIGS. 1A, 1B and 1C show a "before' actuation and 'after' actuation side view of an embodiment (100) of an apparatus to assist paraplegics with getting dressed.
Figure 1B:
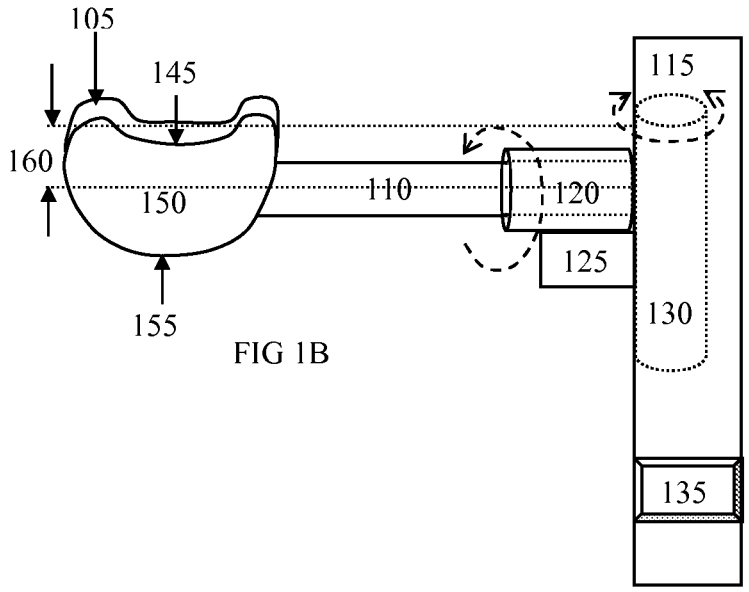
Figure 1C:
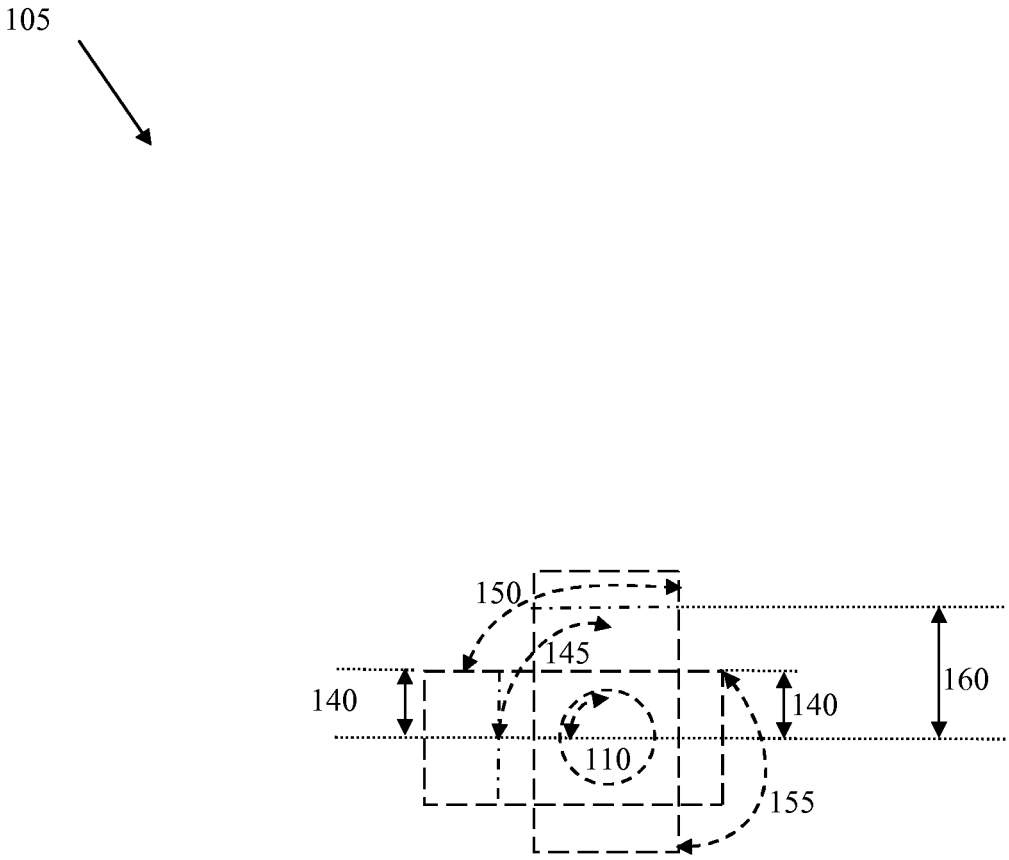

FIGS. 1A, 1B and 1C show a "before' actuation and 'after' actuation side view of an embodiment (100) of an apparatus to assist paraplegics with getting dressed.

Shown in FIG. 1A ("before' actuation) and in FIG. 1B ('after' actuation) are at least one armpit rest (105), at least one lateral support (110), at least one vertical support (115), a rotational support (120), a rotational support affixment (125), a pivot support (130), a vertical adjustment device (135) and an armpit rest thickness (140). Shown additionally in FIG. 1B are an armpit rest lobe (145), at least one approximately flat lateral side (150), an armpit rest edge (155) and an armpit rest lobe height (160).

Embodiment (100) comprises at least one armpit rest (105) which has an armpit rest thickness (140), an armpit rest lobe (145), at least one approximately flat lateral side (150) and an armpit rest edge (155), and an armpit rest lobe height (160), with the armpit rest lobe height (160) being greater than the armpit rest thickness (140).

Embodiment (100) also comprises at least one lateral support (110), a rotational support (120), a rotational support affixment (125). The at least one armpit rest (105) is securely attached to at least one lateral support (110), and which is securely attached to at least one vertical support (115). The rotational support (120) is securely attached to the at least one lateral support (110), with a portion of the rotational support (120) securely affixed to the rotational support affixment (125). Details of the rotational support (120) are shown in FIG. 2.

The at least one armpit rest (105) is the focal point for the user. For one, at least one armpit rest (105) provides a secure place for the user to rest an armpit on the armrest while tending to dressing. More importantly, as described below, the at least one armpit rest (105) actively assists paraplegics with getting dressed.

The at least one armpit rest (105) is typically a soft padding covered with a pliable yet durable material, with a strong support piece inside. The soft padding of the at least one armpit rest (105) may comprise open cell foam, closed foam or both. The pliable yet durable covering may be vinyl, leather or other pliable yet durable material. The strong support piece inside may be made of metal, wood, a plastic, or a composite. Other materials may suffice. The strong support piece inside may be fabricated into the soft padding as part of the at least one lateral support (110), as with injection molding, or if the strong support piece was sewn inside the at least one armpit rest (105). The at least one armpit rest (105) may be made of multiple materials assembled in layers.

The at least one lateral support (110) secures the at least one armpit rest (105) relative to the user, to the rest of the apparatus and to the environment. Depending on structural needs, the at least one lateral support (110) may be made of metal, wood, a plastic, or a composite. Other materials may suffice. The at least one lateral support (110) may be hollow or, solid. The at least one lateral support (110) may be round, square, rectangular, or an any shape, including or channel-shaped as with "U" and "V" brackets or I-beams. As the primary function of the at least one lateral support (110) is to secure the at least one armpit rest (105) relative to the user, the material and shape of the at least one lateral support (110) may be any material or shape fulfilling this function. For comfort, ease or cost of manufacture or assembly, the at least one lateral support (110) may have one or more materials or shapes at some portion, and one or more same or different materials or shapes at other portions of the at least one lateral support (110). In some embodiments, the at least one lateral support (110) is a rod or tube affixed at one end (as with a strong support piece inside) to the at least one armpit rest (105) and is affixed at the other end to the at least one vertical support (115).

Some embodiments may include at least one vertical support (115). The at least one vertical support (115) secures the at least one lateral support (110) relative to the user, the rest of the apparatus and to the environment. Representative forms of the embodiments are shown in FIGS. 3, 4, 5 and 6.

The at least one vertical support (115) may be made of metal, wood, a plastic, or a composite. Other materials may suffice. The at least one vertical support (115) may be may be a wall. The at least one vertical support (115) may be one or more of a hollow or solid material, a plate, or one or more channel-shaped brackets, including "U" and "V" brackets, or I-beams. As the primary function of the at least one vertical support (115) is to secure the at least one lateral support (110) relative to the user, the material and shape of the at least one vertical support (115) may be any material or shape fulfilling this function. For comfort, ease or cost of manufacture or assembly, the at least one vertical support (115) may have one or more materials or shapes at some portion, and one or more same or different materials or shapes at other portions of the at least one vertical support (115).

Figure 3:
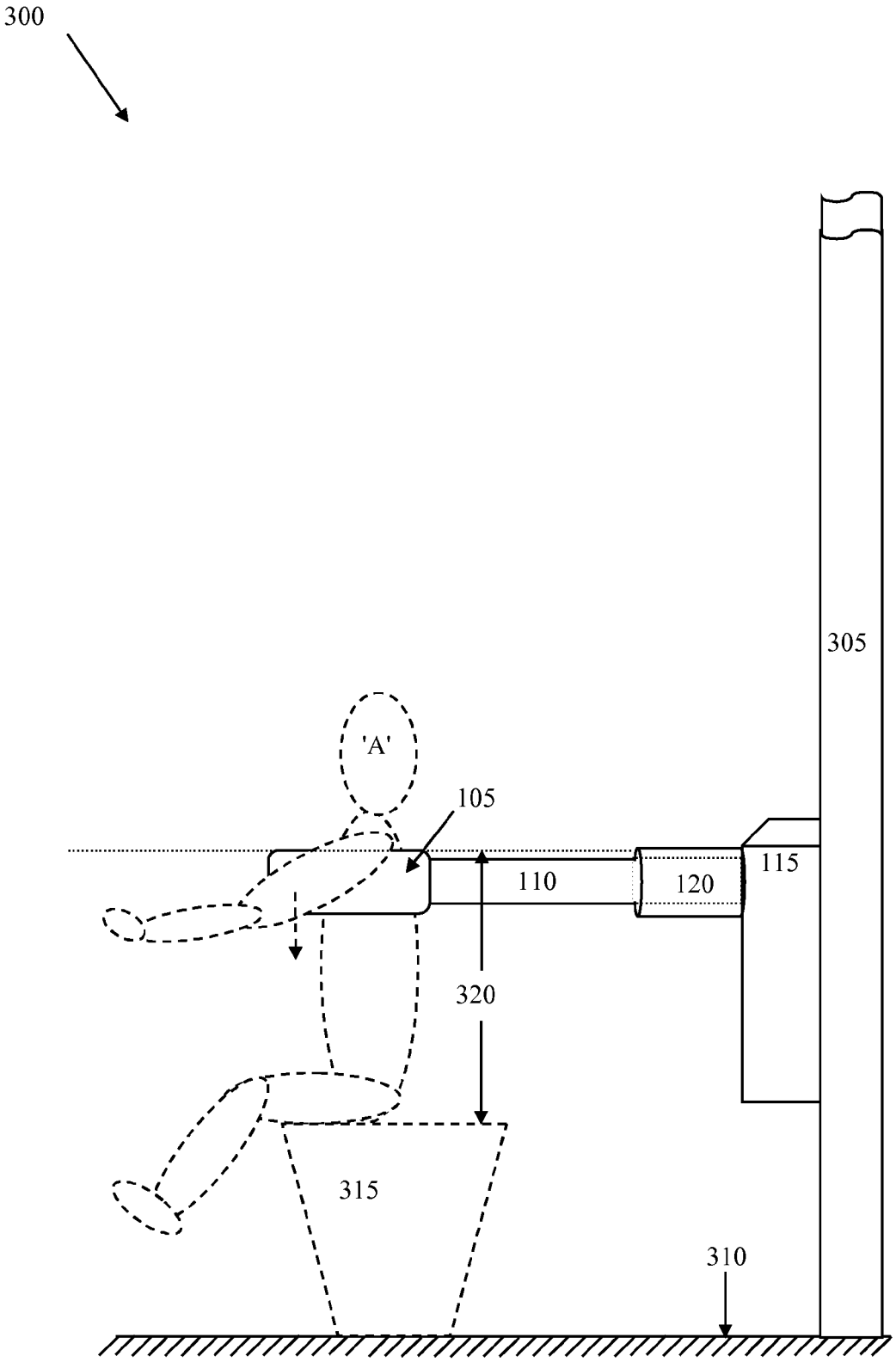
FIG. 3 shows a side view of an embodiment (300) of an apparatus about to assist paraplegics with getting dressed.
Figure 4:
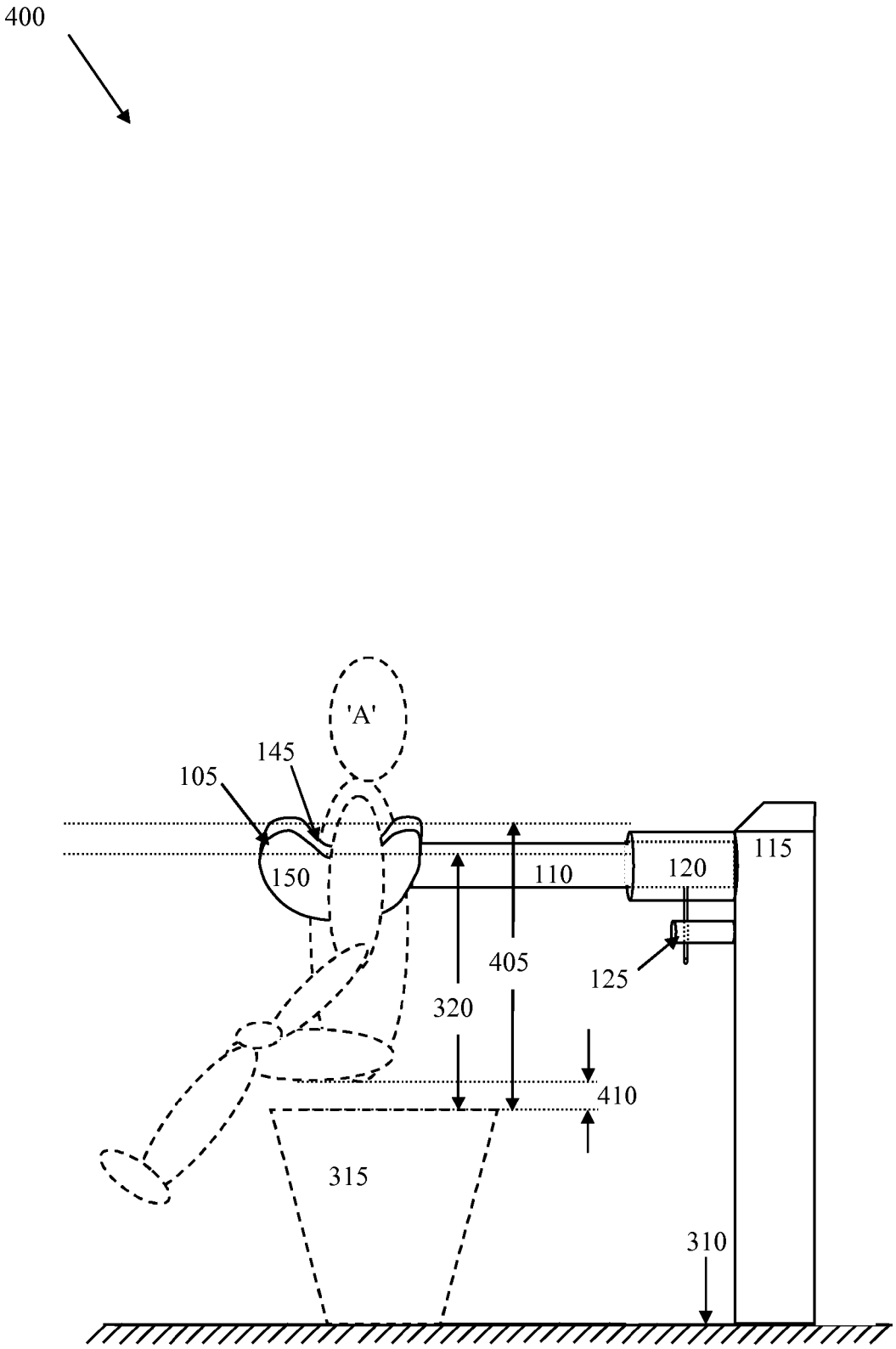
FIG. 4 shows a perspective view of an embodiment (400) of the apparatus assisting a paraplegic with getting dressed.
Figure 5:
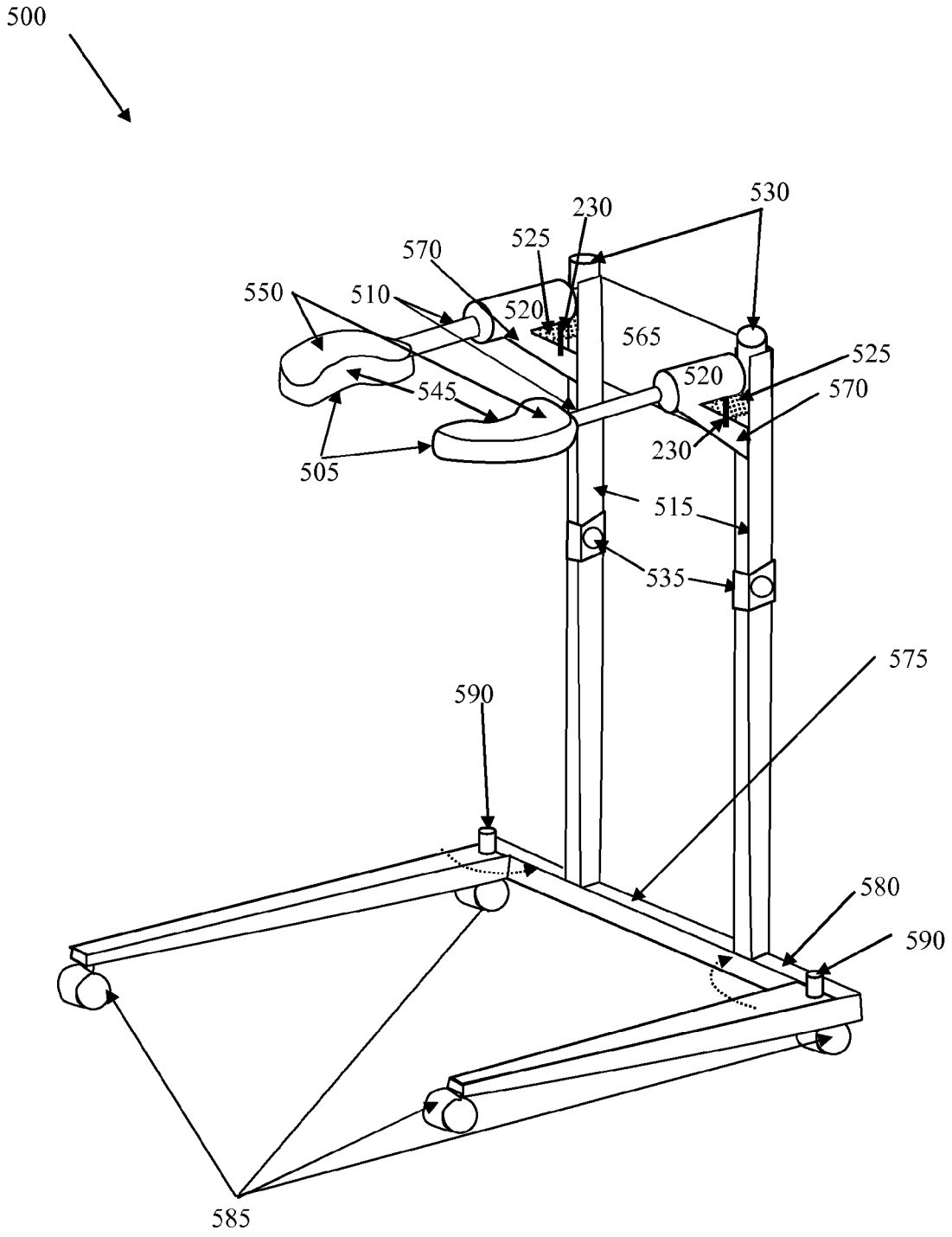
FIG. 5 shows a perspective view of an embodiment (500) of an apparatus to assist paraplegics with getting dressed.
Figure 6:
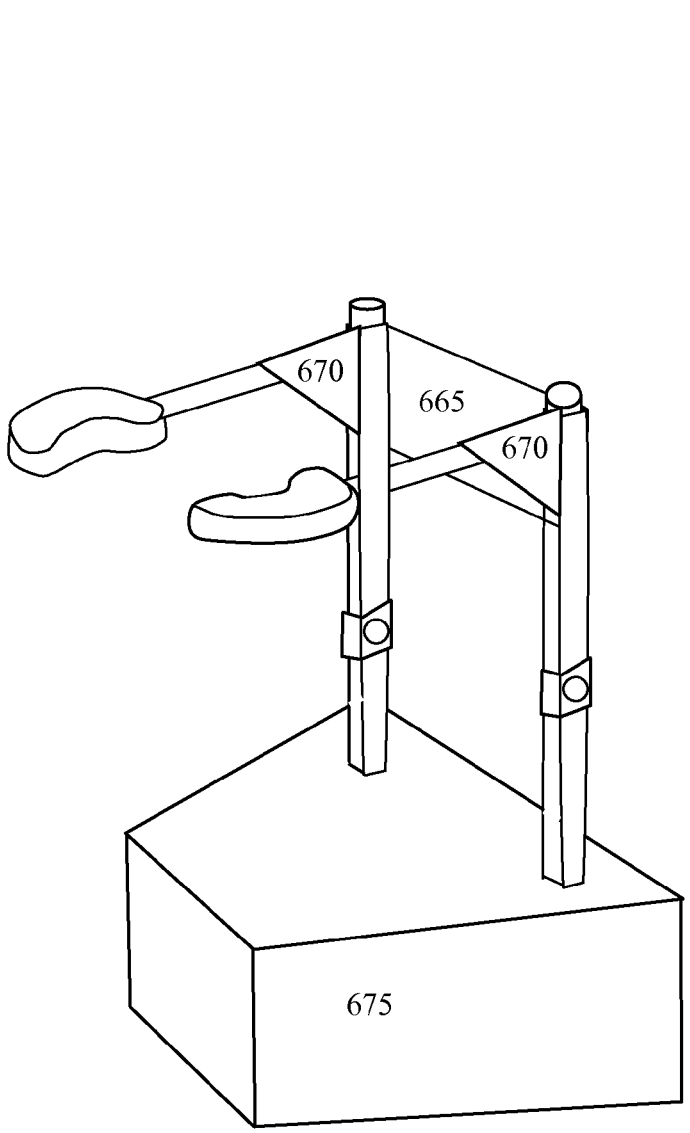
FIG. 6 shows a perspective view of an embodiment (600) of an apparatus to assist paraplegics with getting dressed.

Embodiment (100) may be positioned to allow a user to sit on a seating fixture as shown in FIG. 3, 4 or 6. embodiment (100) also may be positioned relative to existing fixtures in a home, office, restroom, care facility, or other locations. Representative forms of the embodiments are shown in FIGS. 3, 4, 5 and 6.

The apparatus also comprises a rotational support (120). The rotational support (120) is capable of allowing the at least one armpit rest (105) to rotate radially (clockwise and counter-clockwise), and storing energy from the rotation. The rotational support (120) comprises at least one energy storage device (220) affixed to the at least one lateral support (110) and the at least one energy storage device (220) is capable of storing and releasing energy sufficient to rotate the at least one armpit rest (105) from the approximately vertical position to the approximately horizontal position. The rotational support (120) may be any mechanism capable of capable of allowing the at least one armpit rest (105) to rotate relative to the environment, which may be the at least one vertical support (115). FIG. 2 shows the rotational support (120) in detail.

Figure 2A:
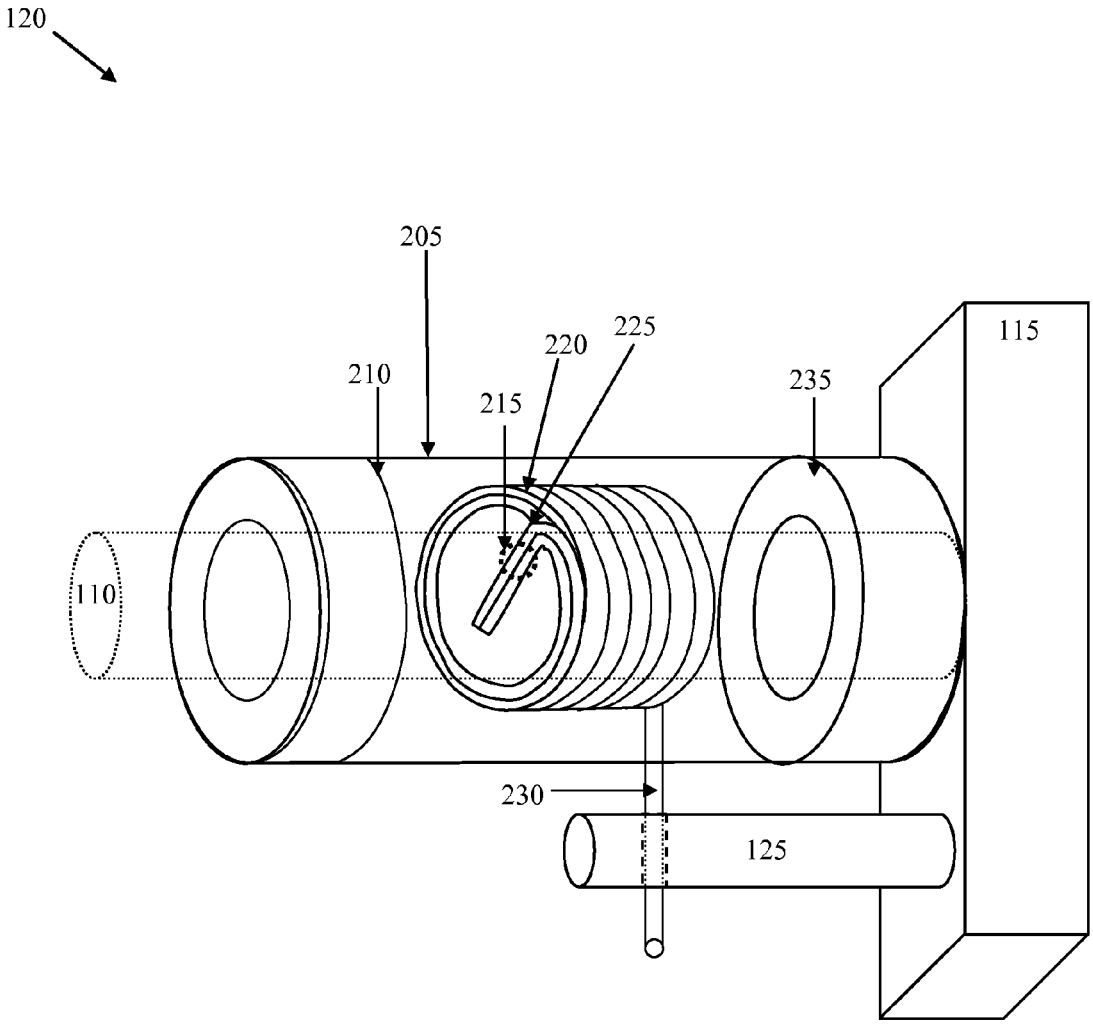
FIGS. 2A and 2B show a detail view of the rotational support (120) for an embodiment (200) of an apparatus to assist paraplegics with getting dressed.
Figure 2B:
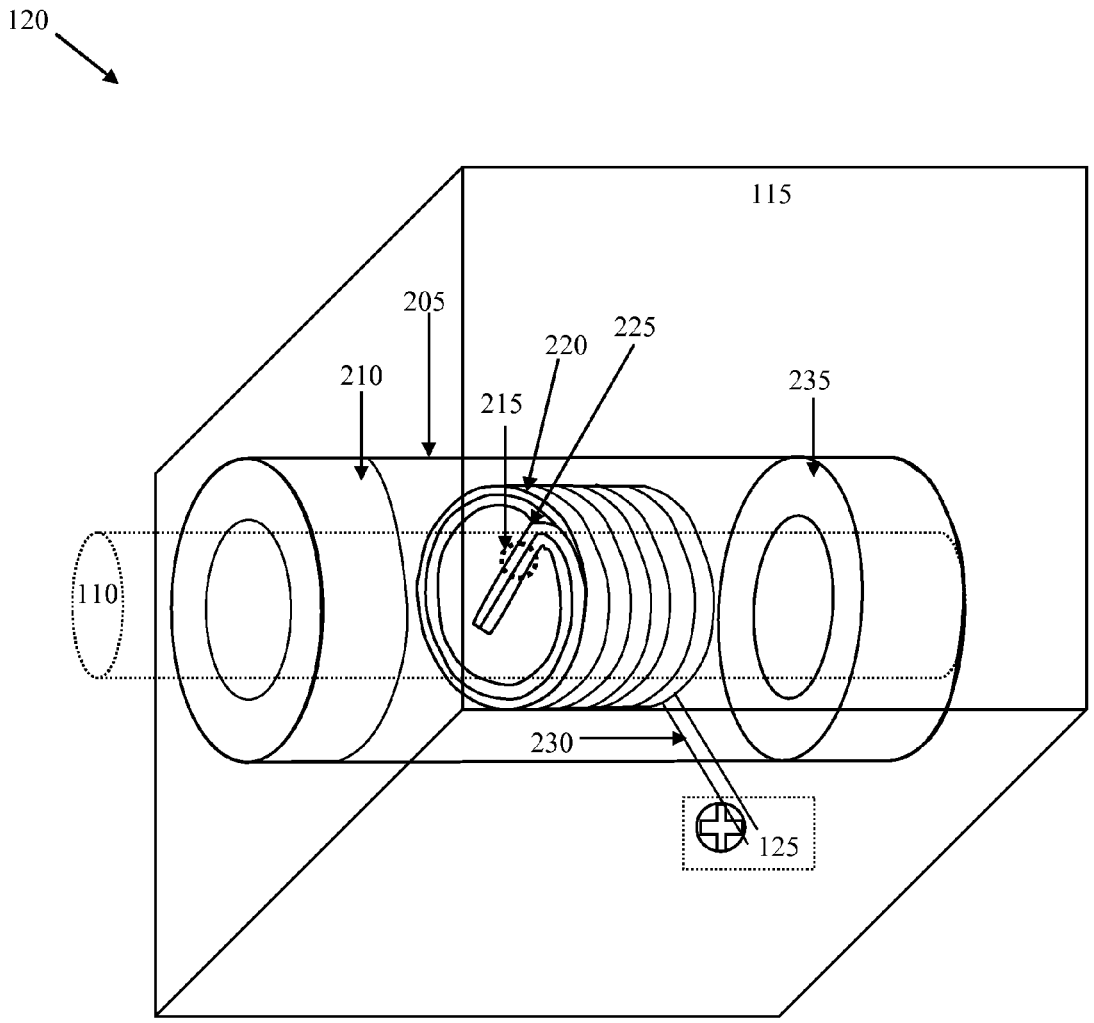

The rotational support (120) is attached at least at one location to the at least one lateral support (110), and is secured at another location relative to the at least one lateral support (110). In some embodiments, the rotational support (120) is secured to or within the at least one vertical support (115). FIG. 2A, 2B and FIG. 6 show examples of how the rotational support (120) may be secured.

Comparing FIG. 1A and FIG. 1B, FIG. 1A represents the apparatus in a default position in which the at least one armpit rest (105) is horizontal with the armpit rest lobe (145) of the at least one armpit rest (105) horizontal, and at least one approximately flat lateral side (150) of the at least one armpit rest (105) facing the vertical. The at least one approximately flat lateral side (150) should be approximately flat or even substantially flat so the user is both comfortable, and not affected by differences on height caused by a surface that is not approximately flat. The limitation of approximately flat does not, however, exclude uneven surfaces which may have one or more pillow-like rises or ridges. Rather, the at least one approximately flat lateral side (150) should have a surface characteristic so that the user's armpit is higher above a seating fixture when on the armpit rest lobe (145) then when the user is supported on the at least one approximately flat lateral side (150).

As shown in FIG. 1B, the at least one lateral support (110) separates the at least one approximately flat lateral side (150) into two virtual halves. One half comprises an armpit rest lobe (145), and a half comprising an armpit rest edge (155). As shown in FIG. 1A, a downward force applied to the armpit rest edge (155) of the at least one approximately flat lateral side (150) causes the at least one armpit rest (105) to rotate, which being successful, moves the armpit rest lobe (145) of the at least one armpit rest (105) to vertical. The at least one approximately flat lateral side (150) of the at least one armpit rest (105) then faces the horizontal, as shown in FIG. 1B.

As the armpit rest lobe height (160) of the armpit rest lobe (145) of the at least one armpit rest (105) is dimensionally greater than the armpit rest thickness (140) of the at least one approximately flat lateral side (150), the at least one armpit rest (105) effectively raises the user upwards by the difference between armpit rest thickness (140) and armpit rest lobe height (160). FIGS. 3 and 4 also show the differences in height. In some embodiments, the armpit rest lobe (145) is concave. In some embodiments, the armpit rest lobe (145) comprises an armpit cavity (545) approximately sized for a human armpit. In some embodiments, the armpit rest lobe (145) is approximately flat. In some embodiments, the armpit rest edge (155) is convex.

As the at least one armpit rest (105) rotates, it also transfers the rotational forces to the at least one lateral support (110), which transfers the rotational forces to the rotational support (120), which stores those forces as energy in the rotational support (120).

When the user releases the downward force on the armpit rest edge (155), the stored energy in the rotational support (120) is transferred back through the at least one lateral support (110). The at least one armpit rest (105) rotates to the default position, and lowers the user down to the seating fixture.

Some embodiments may comprise a pivot support (130) capable of allowing the at least one lateral support (110) to pivot relative to the at least one vertical support (115). In some embodiments, the pivot support (130) is part of the at least one vertical support (115). In some embodiments, the pivot support (130) may be a hinge.

Some embodiments may comprise a vertical adjustment device (135) capable of vertically adjusting the at least one armpit rest (105). In some embodiments, the vertical adjustment device (135) may comprise the at least one vertical support (115) having inter-sliding channels, i.e., square, U or V shapes are typical, which may be un-affixed and affixed to adjust the vertical position of the at least one armpit rest (105).

In some embodiments, the vertical adjustment device (135) may comprise a thumb screw through a hollow penetration of a plate, channel, bracket or tube affixed to the at least one vertical support (115) for adjusting the vertical position of the at least one armpit rest (105).

In some embodiments, the vertical adjustment device (135) may comprise a pin, split pin, cotter pin, non-threaded bolt, etc., removed from a hollow penetration of a plate, channel, bracket or tube affixed to the at least one vertical support (115) for adjusting the vertical position of the at least one armpit rest (105).

In some embodiments, the vertical adjustment device (135) may comprise a bracket affixed to the at least one lateral support (110) so that an adjustment of the vertical position of the at least one lateral support (110) adjusts the vertical position of the at least one armpit rest (105).

In some embodiments, the vertical adjustment device (135) may comprise a jack screw affixed to the at least one vertical support (115) or to the at least one lateral support (110). One or more jack screws may be used.

An embodiment with one of the at least one lateral support (110) could have one vertical adjustment device (135), while an embodiment with a plurality of the at least one lateral support (110) might have more than one vertical adjustment device (135), though, an interconnected set of the at least one lateral support (110) could have one vertical adjustment device (135) securely attached to the plurality of the at least one lateral support (110).

FIG. 1C shows a reduced detail "before' actuation and 'after' actuation front view of an embodiment (100) of an apparatus to assist paraplegics with getting dressed. Shown in FIG. 1C are the at least one armpit rest (105), the at least one lateral support (110), the armpit rest thickness (140), the armpit rest lobe (145), at least one approximately flat lateral side (150), the armpit rest edge (155) and the armpit rest lobe height (160).

As shown and described in FIG. 1A, the default position of the at least one armpit rest (105) is in an approximately horizontal position, 'before' actuation, with the at least one approximately flat lateral side (150) facing upwards in an approximately vertical position. In this configuration, a user may place an arm over the at least one approximately flat lateral side (150) of the at least one armpit rest (105) with the armpit adjacent to the armpit rest lobe (145). As indicated by the armpit rest thickness (140), the user's armpit, and thus the arm, is just that distance above the centerline of the at least one lateral support (110).

The user then presses the arm down over the armpit rest edge (155). This force causes the at least one armpit rest (105) to rotate approximately ninety degrees, clockwise in this view. The user's arm and armpit are then raised as the at least one armpit rest (105) rotates. The user's arm and armpit are then elevated to the height of the armpit rest lobe (145), which is represented by the armpit rest lobe height (160).

The at least one approximately flat lateral side (150) now faces an approximately horizontal position, and the armpit rest lobe (145) faces an approximately vertical position. More importantly, the user is lifted the distance from a line at the armpit rest thickness (140) to a line at the armpit rest lobe height (160), and thus up off of whatever the user was sitting on.

FIGS. 2A and 2B show a detail view of the rotational support (120) for an embodiment (200) of an apparatus to assist paraplegics with getting dressed. FIG. 2A shows the rotational support (120) secured to the at least one vertical support (115). FIG. 2B shows the rotational support (120) secured within the at least one vertical support (115).

Shown in FIGS. 2A and 2B are the at least one lateral support (110, for reference), a rotational support body (205), a first at least one lateral support constraint (210), a lateral support affixment (215), at least one energy storage device (220), a rotational support first end (225), a rotational support second end (230), and as described below, a second at least one lateral support constraint (235).

The rotational support body (205) secures the components of the rotational support (120) in relative position within the rotational support body (205). The rotational support body (205) may be made of metal, wood, a plastic, or a composite. Other materials may suffice. Though shown as cylindrical, the rotational support body (205) may be any shape. In some embodiments, the rotational support body (205) is triangular and may also serve as a diagonal support for the at least one lateral support (110). See FIG. 5.

The first at least one lateral support constraint (210) serves as a stability point for the at least one lateral support (110) within the rotational support body (205). The first at least one lateral support constraint (210) reduces wobble to provide rotational stability to the at least one lateral support (110). While some embodiments may suffice with one lateral support constraint, the risk of injury because of wobble suggests that two lateral support constraints are safer. The first at least one lateral support constraint (210) may be made of metal, wood, a plastic, or a composite, so long as the first at least one lateral support constraint (210) allows the at least one lateral support (110) to rotate and to have stability with respect to the other components during use. Other materials may suffice. In some embodiments, the at least one lateral support (110) is securely affixed to the rotational support (120). In some embodiments, the at least one lateral support (110) is securely affixed within the rotational support (120). In some embodiments, the at least one lateral support constraint is a bushing. In some embodiments, the at least one lateral support constraint is a bearing.

The lateral support affixment (215) constrains the at least one energy storage device (220) to the at least one lateral support (110) at which to transfer the rotational energy from the at least one armpit rest (105) to the at least one energy storage device (220). The lateral support affixment (215) is mated by form and specific function to transfer the rotational energy from the at least one armpit rest (105). In some embodiments, the lateral support affixment (215) comprises a hollow penetration on the at least one lateral support (110) for accepting the a rotational support first end (225). In some embodiments, the lateral support affixment (215) may a clamp, weldment, or other affixment on the at least one lateral support (110) at which to affix the at least one lateral support (110) to the at least one energy storage device (220).

The at least one energy storage device (220) functions to accept, store, and return the energy from the rotation of the at least one lateral support (110) by the rotation of the at least one armpit rest (105). The at least one energy storage device (220) typically has an elastic property capable of accepting, storing, and returning the energy from the rotation of the at least one lateral support (110). In some embodiments, the at least one energy storage device (220) is a spring. In some embodiments, the at least one energy storage device (220) is a torsion bar. In some embodiments, the at least one energy storage device (220) is a ratchet. In some embodiments, the at least one energy storage device (220) is a cam and detent. The detent may be released manually or automatically.

In some embodiments, the at least one energy storage device (220) has a rotational support first end (225) on one end for affixing the at least one energy storage device (220) to the at least one lateral support (110). In some embodiments, the at least one energy storage device (220) has a rotational support second end (230) at an opposing end for affixing the at least one energy storage device (220) in relative position within the rotational support body (205). Though the rotational support first end (225) and the rotational support second end (230) could be closer than on opposing ends of at least one energy storage device (220), the amount of energy a spring is capable of receiving and delivering is a function of the number of energy absorbing parts (typically coils) between the rotational support first end (225) and the rotational support second end (230). The at least one energy storage device (220) may be made of any material capable of receiving, storing, and delivering the energy of rotation from the at least one lateral support (110). Typical materials include metals, i.e., steel or aluminum and their alloys. The at least one energy storage device (220) may also be made of other elastic materials, including a plastic.

The rotational support first end (225) constrains the at least one energy storage device (220) within the rotational support body (205) during rotation of at least one lateral support (110), and transfers the energy of the rotation to the at least one energy storage device (220). The rotational support first end (225) is typically an integral portion of the at least one energy storage device (220), and made of the same material. Typical materials for the rotational support first end (225) include metals, i.e., steel or aluminum and their alloys. The rotational support first end (225) may also be made of other elastic materials, including a plastic.

In some embodiments, the rotational support first end (225) may be made of another material and attached to the at least one energy storage device (220) via an alternate technology. The attachment may be mechanical, including via a clamp, thermal as by welding, or chemical, as generated by a solvent.

The rotational support second end (230) constrains the at least one energy storage device (220) relative to the rotational support body (205) so that at least one energy storage device (220) does not rotate with the at least one lateral support (110) when the at least one lateral support (110) is rotated by the at least one armpit rest (105). The rotational support second end (230) constrains the at least one energy storage device (220) from rotation relative to the rotational support body (205) by being constrained relative to the rotational support body (205) by the rotational support affixment (125). In some embodiments, the rotational support second end (230) may be constrained by the rotational support affixment (125) through a hollow penetration in the rotational support affixment (125). In some embodiments, the rotational support second end (230) may be clamped to the rotational support affixment (125). In some embodiments, the rotational support second end (230) may be welded to the rotational support affixment (125). In some embodiments, the rotational support second end (230) may be secured through a hollow penetration through the at least one vertical support (115). See FIG. 2B.

The rotational support second end (230) is typically an integral portion of the at least one energy storage device (220), and made of the same material. Typical materials for the rotational support second end (230) include metals, i.e., steel or aluminum and their alloys. The rotational support second end (230) may also be made of other elastic materials, including a plastic.

In some embodiments, rotational support second end (230) may be made of another material and attached to the at least one energy storage device (220) to or the rotational support affixment (125) via an alternate technology. The attachment may be mechanical, including via a clamp, thermal as by welding, or chemical, as generated by a solvent.

In some embodiments, a second at least one lateral support constraint (235) may be used to serve as an additional stability point for the at least one lateral support (110) within the rotational support body (205). The second at least one lateral support constraint (235) provides additional wobble-less rotational stability to the at least one lateral support (110). The second at least one lateral support constraint (235) may be made of metal, wood, a plastic, or a composite, so long as the second at least one lateral support constraint (235) allows the at least one lateral support (110) to rotate and to have stability with respect to the other component user during use. Other materials may suffice.

FIG. 3 shows a side view of an embodiment (300) of an apparatus about to assist paraplegics with getting dressed. FIG. 3 represents FIG. 1A, with an addition of user 'A', a relatively immovably support (305), which is relatively immovably in this embodiment due to an attachment to a floor (310), a seating fixture (315), and a first height (320) of A's armpit above a seating fixture (315).

As with FIG. 1A, at least one armpit rest (105) is securely attached to at least one lateral support (110), which is attached to a rotational support (120) as shown FIG. 2A, which is secured relative to user 'A', here by being attached to the at least one vertical support (115).

To use the apparatus, a user gets into position beside the at least one lateral support (110), with the arms out horizontally, and puts the user's armpit over the at least one armpit rest (105). With the at least one armpit rest (105) under the arm pit, the user's armpit is at a first height (320) of A's armpit with respect to the seating fixture (315), i.e., to A's buttocks on the seating fixture (315).

The arm is then lowered. As the arm(s) lower, the arm(s) press on the armpit rest edge (155) (shown in FIG. 1A) of the at least one approximately flat lateral side (150) (shown in FIG. 1B) on the upper side of the at least one armpit rest (105), which turns from a horizontal position to a vertical position, as shown in FIG. 4.

FIG. 4 shows a perspective view of an embodiment (400) of the apparatus assisting a paraplegic with getting dressed. While FIG. 3 represents FIG. 1A with additions, FIG. 4 represents FIG. 1B, with the FIG. 3 additions of user 'A', the relatively immovably support (305), and showing the first height (320) of A's armpit above the seating fixture (315) as in FIG. 3.

Shown in FIG. 4 in addition to the structure shown in FIG. 1B and FIG. 3, are a second height (405) of A's armpit above the seating fixture (315), and a lift distance (410).

Continuing the discussion from FIG. 3, pressing on the armpit rest edge (155) causes a rotation of the at least one armpit rest (105), which turns the armpit rest lobe (145) to an approximately vertical position, and the at least one approximately flat lateral side (150) to an approximately horizontal position.

Consequently, instead of user 'A's armpit being at the first height (320) of A's armpit above the seating fixture (315), user 'A's armpit has been raised to the second height (405) of A's armpit above the seating fixture (315). The difference between the armpit rest thickness (140) and the armpit rest lobe height (160) results in a lift distance (410), which is the difference in height between the first height (320) of A's armpit above the seating fixture (315) and the second height (405) of A's armpit above the seating fixture (315).

By raising 'A' by the lift distance (410) above the seating fixture (315), 'A' is freed from contact with the seating fixture (315), 'A' may now put on or remove pants, or both.

FIG. 5 shows a perspective view of an embodiment (500) of an apparatus to assist paraplegics with getting dressed.

Shown in FIG. 5 are at least one armpit rest (505), at least one lateral support (510), at least one vertical support (515), a rotational support (520), a rotational support affixment (525), a pivot support (530), a vertical adjustment device (535), an armpit rest lobe (e.g., 145) approximately sized as an armpit cavity (545) for a human armpit, at least one approximately flat lateral side (550), a relatively immovably support (565), at least one diagonal support (570), a horizontal frame (575), a movable base (580), a plurality of wheels (585), and a horizontal frame pivot (590). Also shown in FIG. 5 is the rotational support second end (230).

Embodiment (500) is essentially the same as embodiment (100), with the addition of a relatively immovably support (565), at least one diagonal support (570), a horizontal frame (575), a movable base (580), a plurality of wheels (585), and a horizontal frame pivot (590).

In embodiment (500), the apparatus to assist paraplegics with getting dressed is provided with mobility, and may be provided with compactness as well. To provide the equivalent function of a wall as a relatively immovably support, this embodiment provides an alternative stability for the apparatus to assist paraplegics with getting dressed.

Some embodiments may include a relatively immovably support (565). When there is a plurality of the at least one lateral support (510), the relatively immovably support (565) provides stability so the plurality of at least one armpit rest (505) are less likely to move independently of each other.

The relatively immovably support (565) may be made of metal, wood, a plastic, or a composite. Other materials may suffice. The relatively immovably support (565) may be hollow, though the relatively immovably support (565) would typically be solid. The relatively immovably support (565) may be plate affixed to another object, which may be a plurality of the at least one vertical support (515).

As the primary function of the relatively immovably support (565) is to provide an alternative stability function for the apparatus, the material and shape of the relatively immovably support (565) may be any material or shape fulfilling this function. For comfort, ease or cost of manufacture or assembly, the relatively immovably support (565) may have one or more materials or shapes at some portion, and one or more same or different materials or shapes as other portions of the relatively immovably support (565). The relatively immovably support (565) may also be used with the embodiments shown in FIGS. 1, 2, 3 and 4.

Some embodiments may include at least one diagonal support (570). The at least one diagonal support (570) may extend from the at least one vertical support (515) to the at least one lateral support (510), and may extend around the at least one lateral support (510), or may be affixed to the rotational support (520) as a unitary component.

At least one diagonal support (570) may be used to provide additional structural support to embodiments which lack the relatively immovably support (565).

Depending on structural needs, the at least one diagonal support (570) may be made of metal, wood, a plastic, or a composite. Other materials may suffice.

In some embodiments, the rotational support second end (230) may be secured to the at least one diagonal support, in which instance the at least one diagonal support doubles as both the rotational support affixment (125) and the at least one diagonal support (570).

Some embodiments may include an horizontal frame (575). The horizontal frame (575) provides stability for mobility for embodiment (500) of an apparatus to assist paraplegics with getting dressed. The horizontal frame (575) may be affixed to the at least one vertical support (515), and is especially useful for stabilizing embodiment (500) when there are a plurality of at least one vertical support (515). If horizontal frame (575) is bifurcated as shown in FIG. 5, and with a three-sided square or rectangular shape as shown in FIG. 5, then a user may use embodiment (500) with a wheelchair or other chair.

Depending on structural needs, the horizontal frame (575) may be made of metal, wood, a plastic, or a composite. Other materials may suffice.

The horizontal frame (575) may be hollow, solid, a plate affixed to another object, or channel-shaped as with "U" and "V" brackets, I-beams. As the primary function of the horizontal frame (575) is to provide an alternative stability base for the apparatus, the material and shape of the horizontal frame (575) may be any material or shape fulfilling this function. For comfort, ease or cost of manufacture or assembly, the horizontal frame (575) may have one or more materials or shapes at some portion, and one or more same or different materials or shapes at other portions of the horizontal frame (575).

In some embodiments, the horizontal frame (575) comprises a movable base (580). Movable base (580) provides mobility to the apparatus to assist paraplegics with getting dressed. These embodiments may be moved into place for use, as over a seating fixture or restroom fixture, for use, and later moved for use in another location. Depending on structural needs, movable base (580) may be made of metal, wood, a plastic, or a composite. Other materials may suffice. Movable base (580) may be hollow, solid, a plate affixed to another object, or channel-shaped as with "U" and "V" brackets, or I-beams.

As the primary function of movable base (580) is to provide mobility for the apparatus, the material and shape of movable base (580) may be any material or shape fulfilling this function. For comfort, ease or cost of manufacture or assembly, movable base (580) may have one or more materials or shapes at some portion, and one or more same or different materials or shapes at other portions of the movable base (580).

In some embodiments, the movable base (580) further comprises a plurality of wheels (585) attached to the movable base (580) for easy movement of the apparatus. Depending on structural needs, the plurality of wheels (585) may be made of metal, wood, a plastic, or a composite. Other materials may suffice. The plurality of wheels (585) may be hollow, solid or a mix, such as wheels with internal walls or struts.

As the primary function of the plurality of wheels (585) is to for easy movement of the apparatus, the material of the plurality of wheels (585) may be any material fulfilling this function. For comfort, ease or cost of manufacture or assembly, the plurality of wheels (585) may have one or more materials or shapes at some portion, and one or more same or different materials or shapes at other portions of the plurality of wheels (585).

Some embodiments may include an horizontal frame pivot (590). The horizontal frame pivot (590) is capable of allowing the movable base (580), with the plurality of wheels (585) if present, to fold in, thus compacting the apparatus.

FIG. 6 shows a perspective view of another embodiment (600) of an apparatus to assist paraplegics with getting dressed.

Shown in FIG. 6 (but not labeled to leave space for distinctions in this embodiment) are the at least one armpit rest (605), the at least one lateral support (610), the at least one vertical support (615), the rotational support (620), the rotational support affixment (625), the pivot support (630), the vertical adjustment device (635), the armpit rest lobe (645) the at least one flat lateral side (650) and the armpit rest edge (655). Shown and labeled FIG. 6 are a relatively immovably support (665), an at least one diagonal support (670), and a fixed seating fixture (675).

Embodiment (600), like the other embodiments, comprises at least one armpit rest (605), at least one lateral support (610), a rotational support (620), a rotational support affixment (625), an armpit rest lobe (645), at least one flat lateral side (650), and an armpit rest edge (655). As shown here, embodiment (600) also includes a relatively immovably support (665), an at least one diagonal support (670) and a fixed seating fixture (675).

The at least one armpit rest (605), the at least one lateral support (610), the rotational support (620), the rotational support affixment (625), the armpit rest lobe (645), the at least one flat lateral side (650) and the an armpit rest edge (655) function as described earlier.

Some embodiments may include at least one vertical support (615). The at least one vertical support (615) functions as described earlier.

Some embodiments may include a pivot support (630). The pivot support (630). functions as described earlier.

Some embodiments may include a vertical adjustment device (635). The vertical adjustment device (635) functions as described earlier.

Some embodiments may include a relatively immovably support (665). The relatively immovably support (665) functions as described earlier.

Some embodiments may include at least one diagonal support (670). The at least one diagonal support (670) functions as described earlier. The at least one diagonal support (670) shown in FIG. 6 comprises at least one triangular plate or housing, within which may be the rotational support (620) and the rotational support affixment (625). The at least one diagonal support (670) may be affixed to the at least one vertical support.

The fixed seating fixture (675) may be attached to the apparatus as shown. The fixed seating fixture (675) may be a base attached to a floor. The fixed seating fixture (675) may be an existing fixture in a home, office, restroom, care facility, or another location. The fixed seating fixture (675) may be a chair or toilet. The fixed seating fixture (675) may be a wheelchair.

Figure 7:
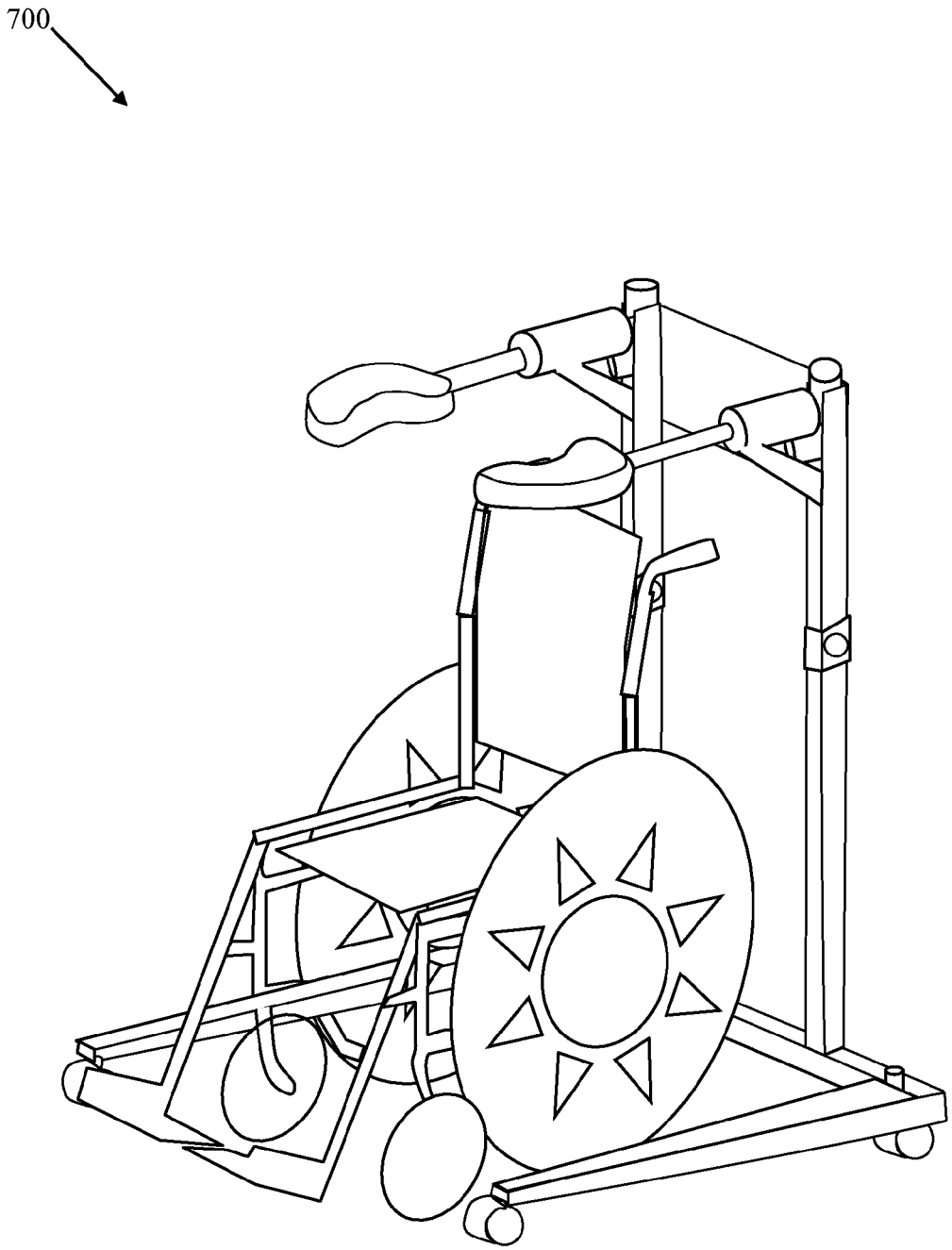
FIG. 7 shows a perspective view of an embodiment (700) of an apparatus to assist paraplegics with getting dressed.

FIG. 7 shows a perspective view of an embodiment (700) of an apparatus to assist paraplegics with getting dressed.

Show in FIG. 7 are the embodiment of FIG. 5 (500), and a wheelchair. As described above, a user would place the user's arms over the at least one armpit rest, lower the arms, and the device will raise the user a few inches. After changing pants, the user can move the user's arms, and be lowered back into the wheelchair.

These descriptions and drawings are embodiments and teachings of the disclosure. All variations are within the spirit and scope of the disclosure. This disclosure is not to be considered as limiting the claims to only the embodiments illustrated or discussed. Certain changes can be made in the subject matter without departing from the spirit and the scope of this invention. It is realized that changes are possible within the scope of this invention and it is further intended that each structure or element recited in any of the claims is to be understood as referring to all equivalent structure or elements. The following claims are intended to cover the invention as broadly as possible in whatever form it may be used.

I claim:

1. An apparatus to assist paraplegics with getting dressed comprising:

at least one armpit rest having an armpit rest thickness, at least one approximately flat lateral side and an armpit rest edge, with an armpit rest lobe of the at least one armpit rest having an armpit rest lobe height, with the armpit rest lobe height greater than the armpit rest thickness, with at least one lateral support securely attached to the at least one armpit rest, with a rotational support securely affixed to the at least one lateral support and capable of allowing the at least one armpit rest to rotate radially from an approximately horizontal position to an approximately vertical position and to return the at least one armpit rest to the approximately horizontal position, and at least one vertical support securely affixed to the at least one lateral support.

2. The apparatus of claim 1, wherein the armpit rest lobe is approximately flat.

3. The apparatus of claim 1, wherein the armpit rest lobe comprises an armpit cavity approximately sized for a human armpit.

4. The apparatus of claim 1 further comprising a vertical adjustment device capable of adjusting the vertical position of the at least one armpit rest.

5. The apparatus of claim 4 wherein the vertical adjustment device comprises inter-sliding channels which may be unaffixed and affixed to adjust the vertical position of the at least one armpit rest.

6. The apparatus of claim 1 wherein the at least one lateral support is securely affixed to the rotational support.

7. The apparatus of claim 1, further comprising a pivot support which is capable of rotating the at least one lateral support horizontally relative to the at least one vertical support.

8. The apparatus of claim 7, wherein the pivot support is a hinge.

9. The apparatus of claim 1 further comprising at least one diagonal support diagonally affixing the at least one lateral support to the at least one vertical support.

10. The apparatus of claim 9 further comprising a rotational support second end securing the rotational support to the at least one diagonal support.

11. The apparatus of claim 1 further comprising a relatively immovably support.

12. The apparatus of claim 1, further comprising a horizontal frame.

13. The apparatus of claim 12 wherein the horizontal frame comprises a movable base (580).

14. The apparatus of claim 13 wherein the movable base comprises a plurality of wheels attached to the movable base.

15. The apparatus of claim 12 wherein the horizontal frame comprises a horizontal frame pivot.

16. The apparatus of claim 1 wherein the rotational support comprises at least one lateral support constraint constraining the at least one lateral support from wobble.

17. The apparatus of claim 16 wherein the at least one lateral support constraint is a bushing.

18. The apparatus of claim 16 wherein the at least one lateral support constraint is a bearing.

19. The apparatus of claim 1 further comprising a fixed seating fixture.

* * * * *